United States Patent [19]

Venetta et al.

[11] 4,135,702

[45] Jan. 23, 1979

[54] METHOD AND APPARATUS FOR PREHEATING SCRAP

[75] Inventors: Henry J. Venetta, Warren; Raymond E. Singrey, Williamsfield; John E. Coughlin, Youngstown, all of Ohio

[73] Assignee: Venetta, Inc., Warren, Ohio

[21] Appl. No.: 737,039

[22] Filed: Oct. 29, 1976

[51] Int. Cl.[2] ..... F27D 3/00

[52] U.S. Cl. ..... 266/44; 75/44 S; 266/901; 432/11; 432/134

[58] Field of Search ..... 75/44 S; 214/18 SC; 266/44, 200, 261, 205, 901; 432/11, 12, 14, 134

[56] References Cited

U.S. PATENT DOCUMENTS

| | | | |
|---|---|---|---|
| 3,133,628 | 5/1964 | Butler et al. | 432/134 X |
| 3,484,231 | 12/1969 | Uzdavines | 266/205 X |
| 3,591,158 | 7/1971 | Pantke | 266/186 X |
| 3,667,747 | 6/1972 | Graybill et al. | 432/134 |
| 3,721,519 | 3/1973 | Venetta | 432/88 |
| 3,813,209 | 5/1974 | Venetta | 432/11 |
| 3,985,497 | 10/1976 | Fellnor et al. | 75/44 S |

OTHER PUBLICATIONS

Jablonski, E., *Flying Fortress*, Doubleday Garden City--New York, 1965, p. 317.

*Primary Examiner*—Roy Lake
*Assistant Examiner*—Paul A. Bell
*Attorney, Agent, or Firm*—Oldham, Oldham, Hudak & Weber Co.

[57] ABSTRACT

A metal batch preheating method comprises positioning an elongate mass of metal scrap on a conveyor in a tunnel furnace for heating such furnace having longitudinally spaced transversely extending zones of greater and lesser heat, the conveyor being loaded with metal for the length of the tunnel furnace except for the last heat zones therein. The metal is thereafter moved through a plurality of "advance and heat" movements in the furnace during the batch heating cycle so that the metal is exposed to both greater intensity and lesser intensity heat zones as it is preheated after which the metal is discharged for use or further processing.

5 Claims, 10 Drawing Figures

METHOD AND APPARATUS FOR PREHEATING SCRAP

Apparatus of the invention includes a tunnel preheat furnace having a jog-advanced type load conveyor extending therethrough. The load conveyor includes a plurality of metal deck plates of generally U-shape in section for metal receipt and transport through the furnace. Means are associated with the bottom portion of the conveyor for controllably supplying gas thereto for transmittal to the metal contents of the conveyor to supply a gas, usually fresh secondary air thereto to facilitate combustion of inflammables on the metal in the conveyor members.

Heretofore there have been a number of different types of preheating apparatus provided for metal such as metal scrap or other material which is to be processed in furnaces for metal manufacture or which is to be used for other purposes.

Previously U.S. Pat. Nos. 3,721,519 on "Furnace Charging Apparatus" and 3,813,209 on the "Preheating of Metal Scrap" have been obtained. The apparatus and the functioning thereof as described in these patents have provided very satisfactory metal preheating actions. However, it naturally is desirable to preheat metal masses as efficiently as possible, and to preheat such metal scrap masses to substantially uniform processing temperatures in a minimum time.

It also has been noted that it is difficult to preheat masses of metal uniformly. The masses of metal to be preheated or processed usually are on transfer conveyors where the metal scrap or mass can be, for example, several feet wide and eight to ten inches deep, be of substantially uniform level, and extend, for example, substantially the length of a furnace that is 15 or 20 feet long so that a large volume of metal is being processed. It is difficult for the heater burners, which normally are at the top of the furnace, to impress a large quantity of heat into the metal in the furnace and to heat this metal uniformly. Normally these burners are positioned in transversely extending sets or rows spaced several feet apart along the longitudinal axis of the furnace. These burners provide zones in the furnace that are not uniformly heated since the burners do have maximum heat output directly in front of or below the burners and intermediate zones longitudinally between the burners do not have the same high temperature heat supplied thereto.

The general object of the present invention is to provide a novel and improved method and apparatus for preheating metal scrap or the like and characterized by an initial movement of the body of scrap into the heating furnace, and then by several jogs or short drive actions of the conveyor at intervals in a heating cycle to move the metal being processed a remaining length of the conveyor and preheat the metal for discharge.

Another object of the invention is to leave a downstream heating area in a furnace empty of metal scrap when filling the remainder of the furnace with an elongate batch of metal scrap to be preheated, and then to cycle the carrier conveyor in the apparatus through a plurality of short drive and rest cycles, whereby the metal being processed is advanced by steps through transversely extending longitudinally adjacent higher and lower temperature zones.

Another object of the invention is to provide a continuous flow of secondary air to a lower portion of a conveyor carrying metal scrap into and through a preheat furnace for metal heating action to aid in burning off combustible materials on the metal in the lower portions of the conveyor.

Another object of the invention is to provide more uniform heating action on a batch of metal scrap being processed by preheat action; to provide a substantially clean, heated scrap from the preheat furnace; and to process a load of metal scrap efficiently in a preheat furnace with substantially maximum heat flow thereto in a limited time.

The foregoing and other objects and advantages of the invention will be made more apparent as the specification proceeds.

Reference now is made to the accompanying drawings, wherein.

Figure 1:
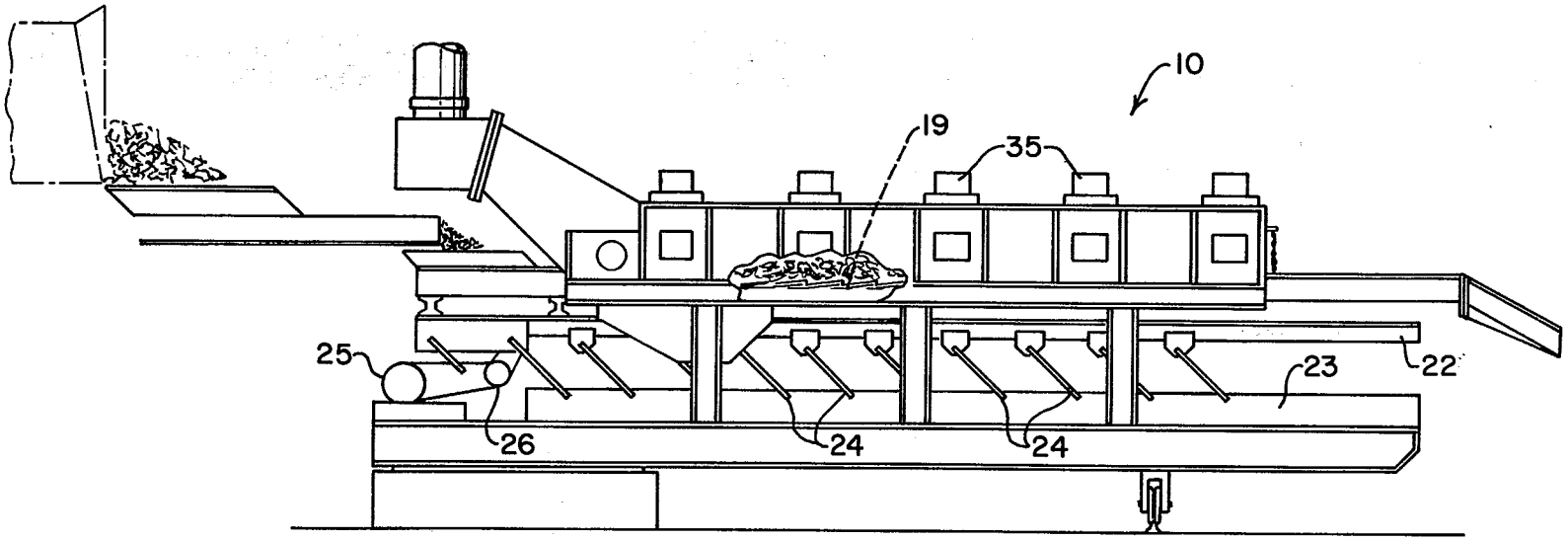
FIG. 1 is a side elevation of a metal preheat furnace embodying the principles of the invention and for practicing the method of the invention.
Figure 6:
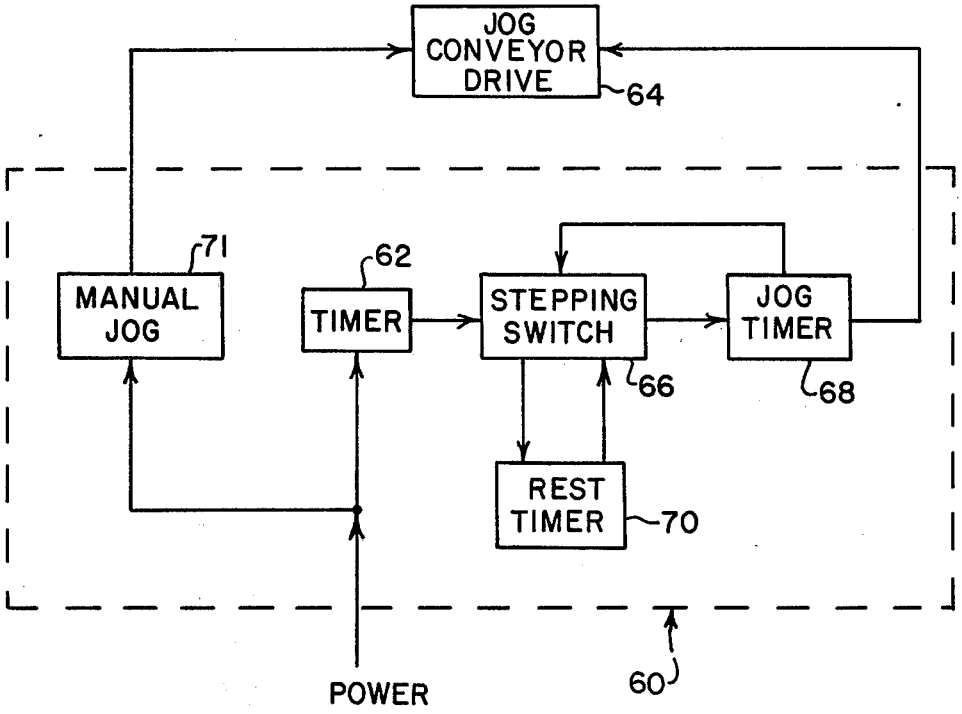
Figure 5:
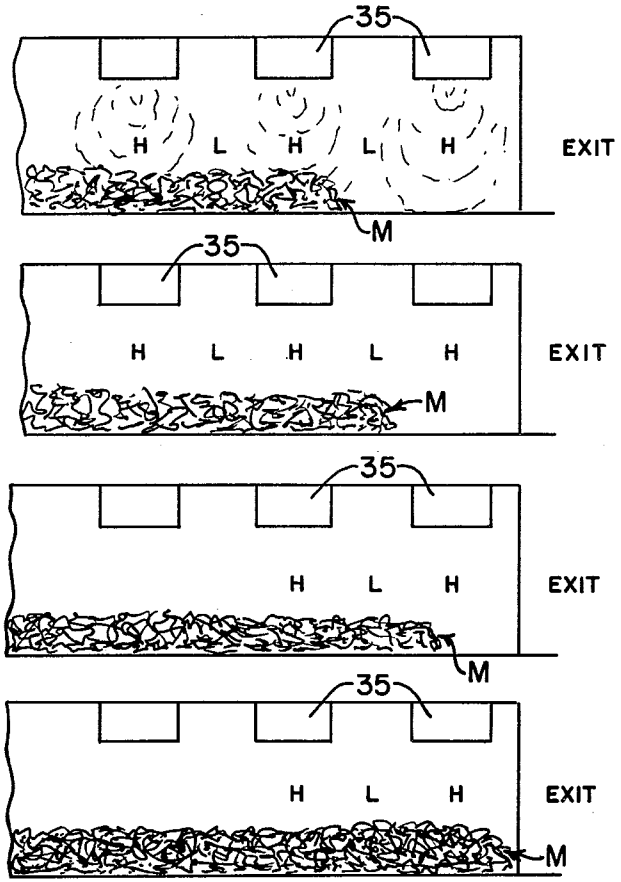
Figure 4:
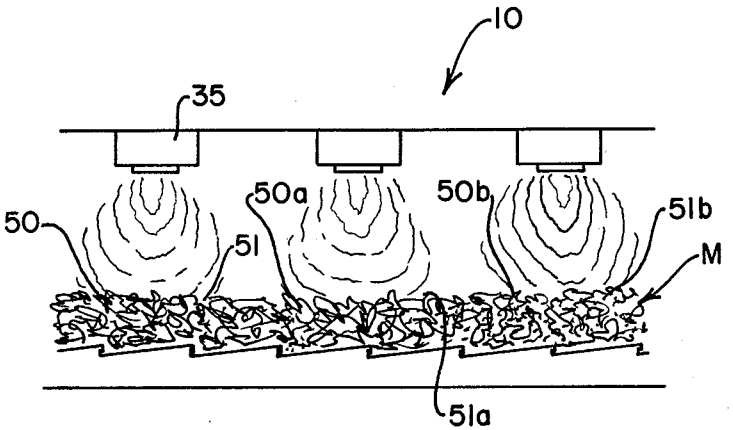
FIG. 4 is a diagrammatic view of the furnace of FIG. 1.

FIGS. 5, 5A, B, C and D are diagrammatic views showing the processing of a batch of metal scrap in the furnace of FIG. 1; and FIG. 6 is a schematic view of a part of the electrical control apparatus of the invention.

SUBJECT MATTER OF INVENTION

The subject invention, as one embodiment thereof, relates to a method of preheating metal involving an elongate furnace having alternate hot and cooler heating areas at longitudinally adjacent portions thereof and it includes moving the metal as an elongate mass into the hot furnace for the length thereof except for the final hotter and cooler areas therein and heating the metal mass for a portion of the heat cycle as it is moved into the furnace and then stopped for a short heating action, advancing the metal pile a fraction of the length of the final heat areas and again heating the metal mass for a fraction of the heat cycle and repeating this advancing and heating action until the heat cycle is complete and part of the metal mass or pile has at least moved into the final preheat areas, the distance of movement for each fractional length movement in relation to the length of the final pair of areas being the same fraction as the length of the heating action is to the total heat cycle, after which action the heated metal pile is discharged from the furnace. The invention also relates to the provision of a conveyor for metal that is positioned in and extends through the furnace, the conveyor including a plurality of transverse extending substantially U-shaped in section deck members or plates that are operatively connected in end to end relation, which deck members or plates have beveled lateral internal contours to avoid positioning metal in hard to heat corner areas of the conveyor, and which conveyor has longitudinally spaced holes or slots operatively formed in its bottom area, and means connect to the conveyor and to the slots therein for supplying fresh combustion air or a gas to the conveyor deck members on the internal surface thereof to aid in the combustion action on combustible materials on the metal being preheated or for other action.

The type of a preheat furnace structure and some of the associated apparatus is very similar shown to that in the prior patents referred to hereinabove. Particularly, the drive and operation of the so-called jogging conveyors are as shown in U.S. Pat. No. 3,721,519 where the conveyor 19 is primarily conventional and is formed from a plurality of deck members or plates 20 that may be secured together or be positioned in overlapped relation. These deck members are suitably carried on and supported by an upper frame structure 22 that is mounted on a lower frame 23 by coil springs (not shown) and by leaf springs 24 on both sides of the apparatus, as indicated in the drawings. Drive is transmitted to the conveyor through a motor 25 and a crank arm, drive arm, and/or eccentric assembly indicated at 26 to provide a more or less of a slingshot action for the frames. The frame 22 and hence the leaf springs 24 are pulled down slowly to about an angle of 45° and then released to have a quick springing action upwardly. This throws or propels the conveyor 19 and the load being processed forwardly in the furnace. The amount of forward throw of the load for each drive or jog action of the conveyor can be fairly well predetermined. The metal mass for preheat is suitably loaded onto the conveyor 19 and moved to fill the furnace 10 to about the last pair of heat zones therein as shown in FIG. 5A. By use of the controls and action of this invention, it is then possible to move the mass of metal being preheated on the conveyor about six inches, for example, longitudinally of the tunnel furnace at selected intervals. Thus, if burners 35 are on two foot centers, for example, and the mass of metal is projected forwardly about six inches with each jogging thereof, then the apparatus can either be manually jogged at suitable time intervals so as to move part of the mass of metal stepwise into and through the last pair of high heat and low heat zones in the furnace, or the conveyor could be automatically jogged. The preheat cycle for a mass of metal being preheated has a portion thereof regulated into fractions corresponding to the number of fractional advancing movement required to move the leading part of the mass of metal through the last paired heat zones in the furnace to obtain substantially uniform preheat action of the entire mass of metal being processed. Thus, after the full preheat cycle, the entire batch of metal would be ready for discharge. Then the drive for the conveyor 20 could be turned on and left on to propel or eject the preheated metal rapidly from the tunnel furnace.

In practicing the method of the present invention, initially metal is fed into and processed through the apparatus in a conventional manner until the conveyor 20 has moved an elongate mass of metal to be preheated into the furnace 10. The furnace is not completely full, and FIGS. 5A, 5B, 5C and 5D show how the downstream end of the metal mass M is moved or jogged by increments through the last heat zones of the furnace, which usually is continuously fired.

It should be realized that the burners 35 must be spaced slightly longitudinally from each other and that the actual hot gas or burning gas area primarily covered by an individual burner 35 would be the area extending, for example, from the general vicinity or areas indicated at 50, 51, **50*a*, 51*a*, 50*b*, 51*b*, etc. as shown in the drawings. Then the portions of the load M between the area 51 and 50*a***, for example, would be in a lower heat area in the furnace so that the metal has different temperatures to which it is exposed in longitudinally spaced portions of the furnace.

It is known that the scrap obviously will be heated to a higher temperature when the burning gases from one of the nozzles 35 most directly impinges on that particular portion of the metal scrap than that heating action on areas or portions of the volume of metal scrap not having the same intensity of gas impinged thereagainst. Thus, as indicated in FIGS. 5A through 5D, there can be considered to be high and low heat areas provided at longitudinally spaced portions of the furnace at the areas indicated "H" and "L."

FIG. 6 of the drawings has a diagrammatic showing therein of how a power supply can connect to a control 60 which has conventional components therein. This control 60 would include a timer 62 which is adjustable in setting and may time four minutes of a six minute preheat cycle, for example, and then complete its cycle to trigger a stepping switch 66. This control hence is moved to the next step or step 2 thereof. In this position, the stepping switch, for example, would actuate a second timer 68 that is connected to the jog conveyor drive 64 to energize it and start and stop its drive motor to jog the scrap on the conveyor a predetermined amount. When this second timer times out, it actuates the stepping switch 66 to move it to a third or next position wherein it actuates a third timer 70 for a resting cycle, such as for 30 seconds, for the jog conveyor drive. At the end of this resting cycle, another step impulse is applied to the stepping switch 66 from the third timer 70 to move it to a fourth step or contact and it again actuates the second timer 68 for another step drive and jog action for the conveyor drive 64 to advance the mass of metal M to the position as shown in FIG. 5C. This second timer cycle being completed, it actuates the switch 66 to step five to actuate the third timer 70 again for a rest cycle after which the stepping switch 66 is again actuated to step six for another step and jog action by the timer 68 and the conveyor drive 64 controlled thereby to move the load to the position of FIG. 5D. A fourth rest cycle next is provided by the timer 68 moving the step switch 66 to step seven to actuate the timer 70. When the timer 70 times out it actuates the step switch 66 to step eight and such step is connected directly to the drive 64 and thus the conveyor drive motor would clear the furnace. Any conventional controls can be used to provide the several step automatic jog and heat action of the invention and the power for jog conveyor drive 64 can be automatically or manually terminated when the conveyor 19 is cleared. Likewise, the drive controls of FIG. 6 can be manually or automatically reset. Obviously the length of initial feed of the scrap into the furnace 10 by the conveyor 19 can be varied as desired and the jog and heat (and rest) steps of the invention then will normally advance the leading end portion of the scrap mass to the end of the furnace. Such initial feed of the scrap into the furnace and the length of such feed can be controlled in any desired manner.

Preferably at least four jog and drive actions are provided for the conveyor drive 64 in each batch heating cycle but any suitable drive impulses can be used.

The benefits of this jog-rest drive type of an action for scrap being conveyed through the furnace are that the scrap that is not initially under the burners 35 for maximum impingement of the burning gases thereagainst will be moved along gradually so as to have all of the mass of metal in the furnace be contacted or struck by maximum velocity, highest heat intensity burning gases being provided in the furnace. Furthermore, the several jog actions during a heating cycle does rearrange the scrap metal in the furnace slightly as to how the metal is stacked on itself. This facilitates flow of air down to the conveyor and through the mass of metal thereon for effective heating action. The automatic jog-drive action can be replaced by a manual override switch or drive control 71 which can be used when desired.

Figure 2:
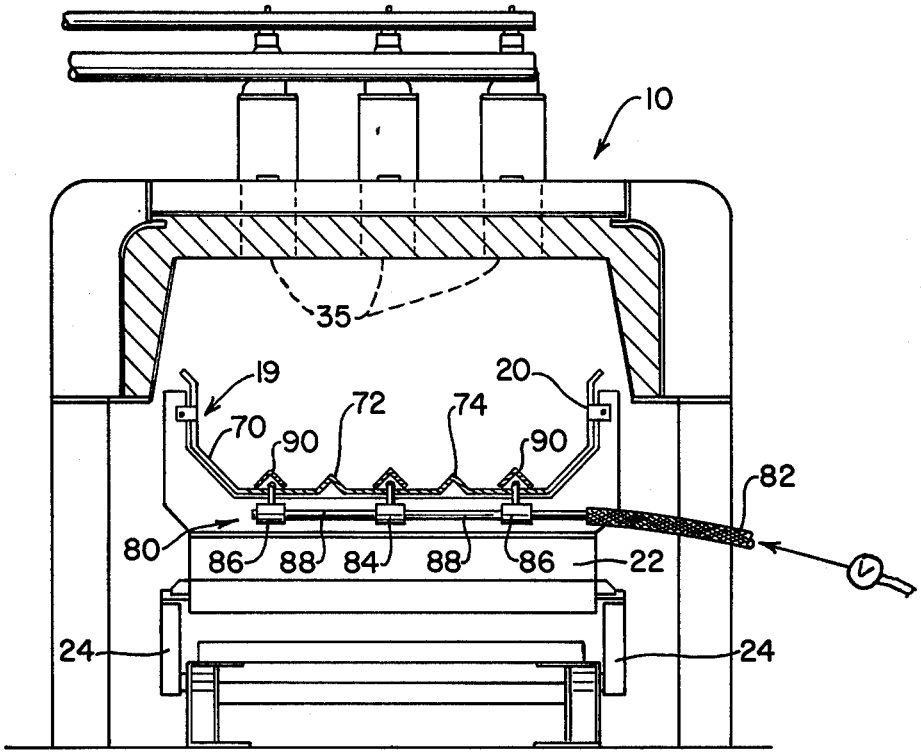
FIG. 2 is a vertical section through the metal preheat furnace of the invention.
Figure 3:
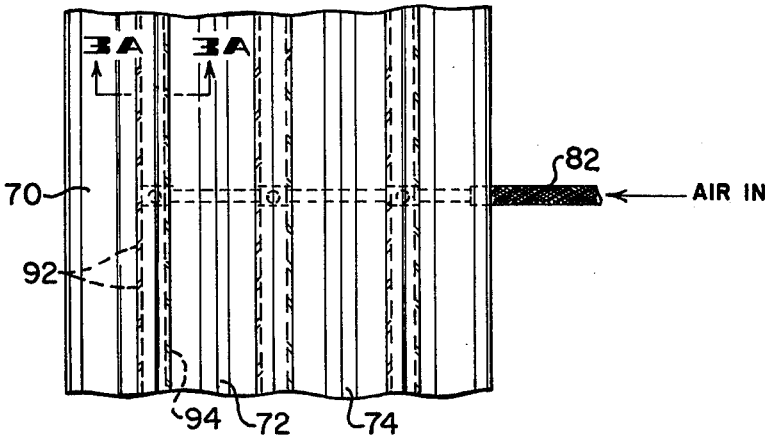
FIG. 3 is a fragmentary plan view of the conveyor of FIG. 2 showing air supply means in association therewith.
Figure 3A:
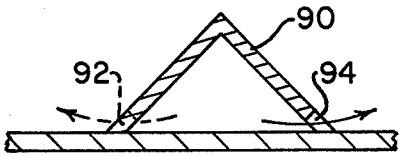
FIG. 3A is a section on line *3a—3a* of FIG. 3.

Yet other features of the apparatus and method of the invention are best shown in FIGS. 2 and 3 wherein it is shown that the deck plates 20 which are of substantially U-shape in horizontal section and which extend transversely of the furnace, have beveled or inclined corners as indicated at 79. These corners are inclined at about 45° to the horizontal and extend upwardly no more than one-half the height of the deck to avoid having scrap metal trapped in bottom corner areas of the conveyor and deck plates thereof where it is harder for the preheat gases and the heat in the furnace to reach and preheat the metal. Yet a further feature of these deck plates comprises the provision of one or more longitudinally extending reenforcing ribs 72 and 74 as shown in FIG. 2. These ribs extend longitudinally of the conveyor and are of inverted V-shape in section being formed in the metal sheet of the deck member.

In order to provide a gas, such as secondary air, to the metal confined at the lower portions of the conveyor 19 as the metal is positioned in and moving through the preheat furnace, means indicated as a whole by the number 80 is associated with the conveyor 19 in the furnace 10. This gas supply means may have steam, air, or any other suitable gas provided therein and it is to be used particularly to aid in burning off any combustible materials associated with or carried on the mass of metal and especially the lowermost metal in the metal mass in the preheat furnace. This air or gas supply means 80 would have a control valve (not shown) provided therein whereby the flow of gas can be controlled manually or automatically depending upon the preheat cycle and the conditions existing therein. The gas is supplied under pressure to a flexible hose 82 that would connect to individual manifolds 84 extending transversely of, usually, each of the individual deck plates 20. Each of these manifolds 84, that are provided in any desired longitudinally spaced relationship with each other on the conveyor, include a plurality of tubular T-connectors 86 the stem of which is secured to and extends through a hole in the bottom of the deck plate 20 and connects to suitable tubular conduits 88 forming the remaining portions of the manifold in association with the hose 82. To distribute the gas or air to the material carried by the conveyor 19, a plurality of longitudinally extending angles 90 are provided and are suitably secured in angularly overturned form as shown in FIG. 2 to extend longitudinally of the deck plates and be directly vertically positioned over the upper ends of the connectors 86. Such angles have a plurality of recessed openings or slots 92, 94 formed in the edge of each flange of the angle for flow of air or gas therethrough. These angles 90 can be welded or otherwise suitably secured to the bottoms of the deck plates 20. Usually these slots 92 and 94 are at an acute angular relationship to the longitudinal axes of the angles 90 to aid in preventing ready movement of dirt and dust particles through these slots to interfere with air and gas flow to the material on the conveyor 19.

The gas supplied through the hose 82 can be at any suitable pressure, usually a low poundage such as 1 to 15 pounds, as this will provide good volume of flow to the metal being preheated. The supply of secondary air for combustion action aids materially in burning off cutting oil, for example, carried by scrap metal being preheated. Such combustion of the cutting oil also aids materially in providing heat to the metal being preheated and reduces requirements for supply of fuel gas to the burners 35 for combustion in the furnace. Other gases may be supplied for other purposes.

From the foregoing, it is seen that the apparatus of the invention has been improved in several ways over prior equipment to make for more efficient preheating action on metals, to provide a cleaner preheated metal, to make the metal be of more uniform temperature as supplied to the furnace, and to provide a readily controllable or variable intermittent jog action for scrap metal being preheated in a preheat batch operation for better preheat action. Thus, the objects of the invention are submitted to be achieved.

While one complete embodiment of the invention has been disclosed herein, it will be appreciated that modification of this particular embodiment of the invention may be resorted to without departing from the scope of the invention.

What is claimed is:

1. In a metal batch preheating method wherein a tunnel furnace, and a heat resistant conveyor positioned in and extending through the furnace for carrying metal to be heated are provided, which furnace has longitudinally spaced transversely extending zones of greater heat intensity than areas intermediate said zones, and including the steps of loading the conveyor with a metal mass for the length of the tunnel furnace except for at least a portion of the last greater intensity heat zone, terminating the conveyor drive, heating the metal mass with some longitudinally spaced areas thereof being made hotter than adjacent areas, again driving the conveyor to move its contents a fraction of the remaining unloaded length of the furnace, terminating the conveyor drive and heating as before, again driving the conveyor to move its contents another fraction of the unloaded furnace length, stopping the conveyor and heating, supplying fresh secondary air directly to the bottom portions of the metal mass being heated to aid in burning off any combustible adhering thereto, and discharging the heated metal mass after the metal mass has been subjected to several short advance, stop and heat cycles.

2. In a metal batch preheating method wherein a tunnel furnace, and a heat resistant conveyor positioned in and extending through the furnace for carrying metal to be heated are provided, which furnace has longitudinally spaced transversely extending zones of greater heat intensity than areas intermediate said zones, and including the steps of loading the conveyor with a metal mass for the length of the tunnel furnace except for at least a portion of the last greater intensity heat zone, terminating the conveyor drive, heating the metal mass with some longitudinally spaced areas thereof being made hotter than adjacent areas, again driving the conveyor to move its contents a fraction of the remaining unloaded length of the furnace, terminating the conveyor drive and heating as before, again driving the conveyor to move its contents another fraction of the unloaded furnace length, stopping the conveyor and heating, supplying the conveyor and its contents with a gas injected into the conveyor from the bottom thereof, and discharging the heated metal mass after the metal mass has been subjected to several short advance, stop and heat cycles.

3. In apparatus for preheating metal, a furnace, a load conveyor positioned in the furnace to carry metal into and through the same, and burner means in the top of the furnace and directed downwardly thereof, and wherein said load conveyor comprises a plurality of transversely extending metal plates of generally U-shape in section, and said plates having one or more longitudinally directed, upwardly extending reenforcing ribs in the bottom thereof, a longitudinally extending angle inverted over the bottom of each of said plates, and means for supplying a volume of gas to said metal plates below said angles, said angles being apertured to permit gas flow therethrough to contact material in the lower portions of said conveyor.

4. In apparatus for preheating metal, a furnace, and a driven load conveyor positioned in the furnace to carry metal into and through the same, and wherein said load conveyor comprises a plurality of transversely extending metal plates of generally U-shape in section, that are operatively connected, said plates having opposed lower corners inclined upwardly at about 45° but which corners do not extend up beyond about one-half the vertical height of said metal plates, gas supply means positioned below said conveyor and operatively connecting to the interior of the conveyor adjacent the bottom thereof to supply a stream of compressed gas thereto, and means to control flow of said stream, and said metal plates being operatively secured together in end to end relation and secured to an upper frame structure, spring means support said upper frame structure, and drive means connect to said upper frame structure for a controlled jog drive advance of material on said load conveyor.

5. In apparatus for preheating metal, a furnace, a load conveyor positioned in the furnace to carry metal into and through the same, and burner means in the top of the furnace and directed downwardly thereof, and wherein said load conveyor comprises a plurality of transversely extending metal plates of generally U-shape in section, said plates having one or more longitudinally directed reenforcing ribs in the bottom thereof, longitudinally extending gas distributors positioned over the bottoms of said metal plates and operatively secured thereto, and means operatively connecting to said metal plates for supplying a volume of gas to said metal plates for flow to an area below said gas distributors, said gas distributors and plates being operatively engaged to permit gas flow out from a partial enclosure formed by said gas distributors and said metal plates to contact material in the lower portions of said conveyor.

* * * * *